United States Patent [19]

Blackburn et al.

[11] 4,266,940

[45] May 12, 1981

[54] METHOD FOR DYEING ACRYLONITRILE POLYMER AND COPOLYMER FIBRES

[75] Inventors: David Blackburn, Leeds; Malcolm S. Wild, Heckmondwike, both of England

[73] Assignee: Yorkshire Chemicals Limited, Leeds, England

[21] Appl. No.: 16,690

[22] Filed: Mar. 2, 1979

[30] Foreign Application Priority Data

Mar. 2, 1978 [GB] United Kingdom ..... 8218/78

[51] Int. Cl.[3] ..... D06P 3/70

[52] U.S. Cl. ..... 8/538; 8/927

[58] Field of Search ..... 8/177 AB, 538, 927

[56] References Cited

U.S. PATENT DOCUMENTS 3,643,270 2/1972 Kirschnek et al. ..... 8/177 AB

FOREIGN PATENT DOCUMENTS 734974 5/1953 United Kingdom .
991957 5/1965 United Kingdom .
992175 5/1965 United Kingdom .
1294994 11/1972 United Kingdom .
1483311 8/1977 United Kingdom .
2017156 10/1979 United Kingdom ..... 8/538

*Primary Examiner*—William F. Hamrock
*Attorney, Agent, or Firm*—Beveridge, DeGrandi, Kline & Lunsford

[57] ABSTRACT

There is disclosed a process for the coloration of wet spun acrylic and modacrylic fibres in the gel form which comprises using a cationic dye, or its dye bases, which are substantially insoluble in water but soluble or partly soluble in organic solvents. There are also disclosed acrylic fibres so colored.

9 Claims, No Drawings

METHOD FOR DYEING ACRYLONITRILE POLYMER AND COPOLYMER FIBRES

BACKGROUND OF THE INVENTION

It is well-known that acrylonitrile polymer and copolymer fibres which are produced by a wet-spinning process exist for a time during the manufacturing process in a gel form. In this form they have a very open structure which enables them to be dyed much more quickly and at much lower temperatures than would be the case for a fully processed and stabilised fibre. When dyeing this gel form it is often advantageous to apply the dyes from highly polar solvents, such as dimethyl acetamide, dimethyl formamide, dimethyl sulphoxide or ethylene glycol carbonate which are solvents or partial solvents for the acrylic fibre. Conventional basic dyes, whilst exhibiting good affinity for the acrylonitrile polymer and copolymer fibre, often have low solubility in some of these solvents which limits their use in such a dyeing process. We have found that certain modifications to the structure of these basic dyes improve their solubility in such solvents. In addition these modifications render the dyes virtually insoluble in water and we have found this to be beneficial in reducing the extent to which dye is washed off the dyed fibre in the aqueous rinsing processes which usually follow the dye application process.

SUMMARY OF THE INVENTION

According to the present invention therefore, a process is provided for the colouration of wet spun acrylic and modacrylic fibres (as hereinafter defined) in the gel form which comprises using cationic dyes or their dye bases which are substantially insoluble in water but soluble or partly soluble in a highly polar organic solvent which is also a solvent for the acrylonitrite polymer or copolymer used to produce the fibres, (particularly that actually used for dissolving the acrylonitrile polymers and copolymers prior to the spinning stage), said cationic dye having the formula $$D^+X^-$$

wherein D represents a cationic dye radical containing a chromophoric group, and X represents an anion which renders the dye substantially insoluble in water.

DETAILED DESCRIPTION

Dyeing may take place from baths containing these highly polar organic solvents, optionally in admixture with other organic solvents or water at a temperature of 20°–110° C. for a period typically of 120 seconds.

The terms acrylic fibres and modacrylic fibres cover those fibres which the U.S. Federal Trade Commission defines as follows:- "Acrylic fibre"- A manufactured fibre in which the fibre forming substance is any long chain synthetic polymer composed of at least 85% by weight of acrylonitrile units; "Modacrylic fibre"- A manufactured fibre in which the fibre forming substance is any long chain synthetic polymer composed of less than 85% but at least 35% by weight of acrylonitrile units. Preferred fibres for use in the process are those defined above as acrylic fibres.

As examples of dye chromophoric groups there may be mentioned monoazo, disazo, methine, azomethine, diarylmethane, triarylmethane, oxazine, anthraquinone naphthostyryl, quinophthalone or benzimidazole.

As examples of cationic dye radicals may be mentioned the cationic radicals of the dyes listed in the Basic Dyes section of the Colour Index and recommended therein for application to acrylic fibres. The Colour Index is published by the Society of Dyers and Colourists, P.O. Box 244, Bradford BD1 2JB, West Yorkshire.

As examples of anions which render the dye substantially insoluble in water there may be mentioned chloride, bromide, iodide, carbonate, bicarbonate, sulphate, bisulphate, phosphate, dihydrogenphosphate, perchlorate, benzenesulphonate, p-toluene sulphonate and preferably thiocyanate.

Although the dyes are soluble in the highly polar organic solvents employed in the process of the invention, they are substantially insoluble in water and so the amount of dye washed off the dyed fibre in the aqueous rinsing processes which usually follow the dye application process is very much lower than when conventional basic dyes are employed. If required the fibres may be subjected to a stretching treatment during the dyeing process.

Suitable highly polar organic solvents which are used in the process of the invention and which either alone or in admixture with water or other organic solvents form a dyebath for the dyeing of the gel form of the acrylic or modacrylic fibres are for example dimethylformamide, dimethylacetamide, dimethylsulphoxide, ethylene glycol carbonate and mixtures thereof.

As examples of optional organic solvents which may be used in the dyebath there may be mentioned butanol, ethylene glycol, diethylene glycol, 2-methoxyethanol, 2-ethoxyethanol, toluene and xylene.

After the gel filaments have been dyed they may be subjected to further treatments common to wet spinning processes such as rinsing, drawing/stretching, heat treating, crimping and drying.

The present invention also provides acrylic fibres whenever dyed in accordance with the process of the invention.

The invention will be more clearly understood by reference to the following Examples in which parts and percentages are by weight.

EXAMPLE 1

An acrylonitrile copolymer of 91.4% of acrylonitrile, 5.2% of methyl acrylate and 3.4% of sodium methalkyl sulphone was dissolved in dimethylformamide to form a 24% solution which was extruded through a spinnerette into a combined spinning and dyeing bath consisting of 50% dimethyl formamide, 50% of water and a dye of formula:

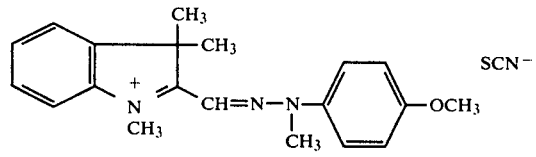

at a concentration of 30 g per litre of liquor at room temperature. In order to remove the organic solvent, the tow was passed through a tank filled with water at room temperature. A pair of pressure rollers was mounted at the outlet end of the tank. The dyed tow was then drawn, stabilised and dried by the usual processes. The fibre was dyed reddish yellow of good fastness properties.

Considerably less bleeding was observed in the rinsing bath with this dye than with conventional cationic dyes.

The dye thiocyanate may be prepared by the addition of ammonium thiocyanate solution to a solution of the dye in the form of a soluble anion.

EXAMPLE 2

An acrylonitrile copolymer with the same composition as in Example 1 was dissolved in dimethylformamide to form a 24% solution which was extruded through a spinnerette into a spinning bath consisting of 50% dimethylformamide and 50% water at 7° C. The tow was passed through a rinsing tank filled with water at room temperature. The tank was fitted at the inlet and outlet ends with pressure rollers and the tow was given a 1.5:1 stretch. Thereafter the tow was passed through a further tank containing dimethylformamide, and a dye of formula:

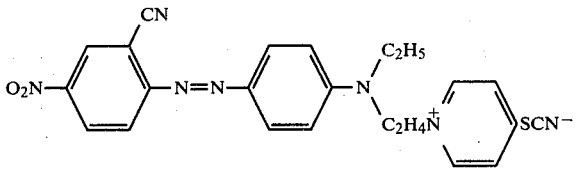

at a concentration of 30 g per liter of solution at room temperature. After rinsing the dyed tow was fixed by steaming, stabilised and dried by the usual methods. The fibre was dyed bluish-red of good fastness properties.

EXAMPLE 3

An acrylonitrile copolymer with the same composition as in Example 1 was dissolved in dimethylacetamide to form a 24% solution and extruded through a spinnerette into a spinning bath consisting of 50% dimethyl-acetamide and 50% water at room temperature. The tow was passed through pressure rollers into a further tank consisting of 50% dimethylacetamide 50% butanol and a dye of formula:

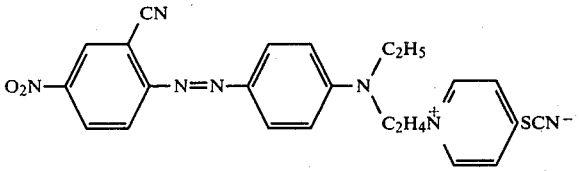

at a concentration of 30 g per liter of liquor at 40° C. The dyed tow was rinsed, fixed, drawn and dried by the usual processes. The fibre was dyed red shades of good fastness properties.

In the following table, data is given referring to other dyes or dye bases which are soluble in selected highly polar organic solvents and insoluble in water and may be used for dyeing acrylic and modacrylic fibres in the gel form in accordance with the general methods described in the previous Examples.

| Example | Dye | Shade on acrylic fibres |
|---|---|---|
| 4 | 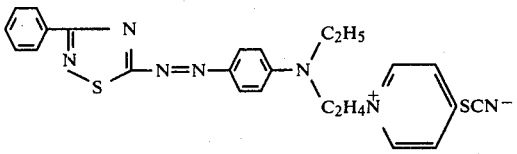 | Red |
| 5 | 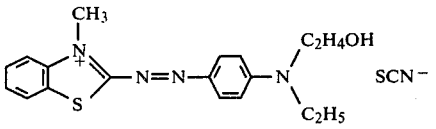 | Blue |
| 6 | 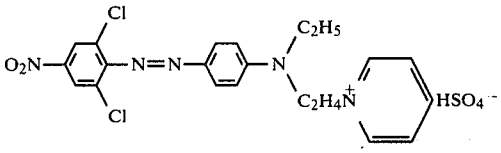 | Reddish brown |
| 7 | 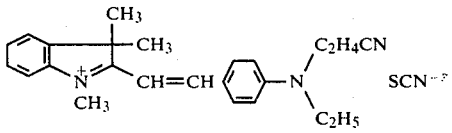 | Bright red |
| 8 | 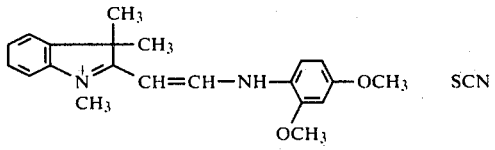 | Yellow |

-continued

| Example | Dye | Shade on acrylic fibres |
|---|---|---|
| 9 | 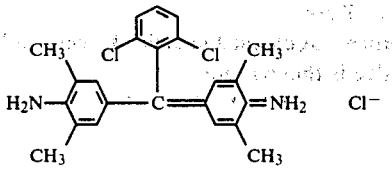 | Blue |
| 10 | 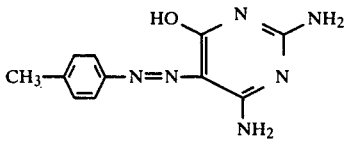 | Yellow |
| 11 | 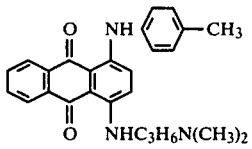 | Blue |
| 12 | 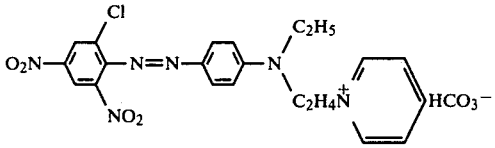 | Violet |
| 13 | 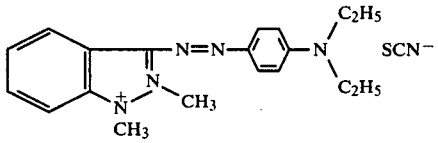 | Violet |
| 14 | 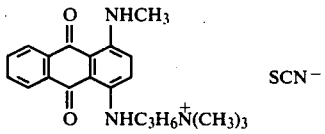 | Blue |
| 15 | 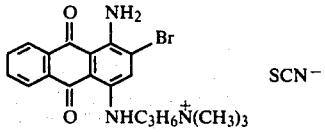 | Blue |
| 16 | 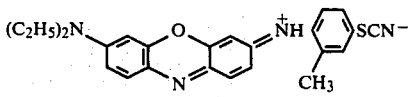 | Blue |

We claim:

1. A process for the colouration of wet spun acrylic or modacrylic fibres in gel form, said process comprising dyeing said fibres at 20°-110° C. from a bath in which a cationic dye or dye base is dissolved, wherein said bath contains a highly polar organic solvent in which acrylonitrile polymer and copolymer of said fibers are soluble and in which said dye and dye base are soluble or partly soluble;

removing said fibres after colouration from said bath; and rinsing said coloured fibres with an aqueous medium without substantially removing said dye from said fibres; wherein said dye has the formula $$D^+X^-$$

where D represents a cationic dye radical containing a chromophoric group and X represents an anion that renders the dye substantially insoluble in water; and wherein said highly polar organic solvent is selected from the group consisting of dimethylformamide, dimethylacetamide, dimethylsulphoxide, ethylene glycol carbonate and mixtures thereof.

2. A process as claimed in claim 1, in which the highly polar organic solvent is admixed with another organic solvent or water.

3. A process as claimed in claim 2, wherein said other solvent is selected from the group consisting of butanol, ethylene glycol, diethylene glycol, 2-methoxyethanol, 2-ethoxyethanol, toluene and xylene.

4. A process as claimed in claim 1, wherein the chromophoric groups is a monoazo, methine, azomethine, diarylmethane, triarylmethane, oxazine, anthraquinone, naphthostyryl, quinophthalone or benzimidazole group.

5. A process as claimed in claim 1, wherein the anion X- is chloride, bromide, iodide, carbonate, bicarbonate, sulphate, bisulphate, phosphate, dihydrogenphosphate, perchlorate, benzenesulphonate, p-toluene sulphonate or thiocyanate.

6. A process as claimed in claim 1, wherein the fibres may be subjected to a stretching treatment during the dyeing process.

7. A process as claimed in claim 1, wherein after colouration, the gel filaments are subjected to one or more further treatments selected from the group consisting of drawing/stretching, heat treating, crimping and drying.

8. A process as claimed in claim 1 in which the fibres are acrylic fibres.

9. A process as claimed in claim 1, wherein X in said cationic dye is thiocyanate.

* * * * *